US005823754A

United States Patent [19]

Lee

[11] Patent Number: 5,823,754

[45] Date of Patent: Oct. 20, 1998

[54] MANUAL PUMP

[76] Inventor: Tzu-Chi Lee, No. 14, Alley 2, Lane 118, Sec. 2, Ho-Ping E. Rd., Taipei City, Taiwan

[21] Appl. No.: 838,057

[22] Filed: Apr. 17, 1997

Related U.S. Application Data

[62] Division of Ser. No. 700,115, Aug. 20, 1996, abandoned.

[51] Int. Cl.[6] ..... F04B 39/10; E03D 11/00

[52] U.S. Cl. ..... 417/437; 417/571; 4/255.08

[58] Field of Search ..... 417/234, 437, 417/569, 571; 4/255.01, 255.02, 255.03, 255.08

[56] References Cited

U.S. PATENT DOCUMENTS

| | | | |
|---|---|---|---|
| 1,769,061 | 7/1930 | Hitchcock | 4/255.03 |
| 2,259,644 | 10/1941 | Kling | 4/255.03 |
| 2,267,064 | 12/1941 | Wikelund | 4/255.08 |
| 2,456,092 | 12/1948 | Storevik | 4/255.03 |
| 4,053,955 | 10/1977 | Canham | 4/255.03 |
| 4,542,543 | 9/1985 | Irwin | 4/255.02 |
| 5,071,325 | 12/1991 | Tupper et al. | 417/496 |
| 5,156,538 | 10/1992 | Lee | 417/571 |
| 5,239,708 | 8/1993 | Irwin | 4/255.08 |

FOREIGN PATENT DOCUMENTS

| | | | |
|---|---|---|---|
| 965570 | 9/1950 | France | 4/255.02 |
| 348268 | 5/1937 | Italy | 4/255.02 |

*Primary Examiner*—Timothy Thorpe
*Assistant Examiner*—Peter G. Korytnyk
*Attorney, Agent, or Firm*—Morgan & Finnegan, LLP

[57] ABSTRACT

A manual pump includes first and second tubular members. The first tubular member has an upper closed end, a lower open end, and a piston member extending through and mounted movably in the first tubular member. The second tubular member has an upper open end which is fixed sealingly to the lower open end of the first tubular member, a lower closed end, an inflow check valve, an outflow check valve, and two connecting tubes connected to the external face of the second tubular member. Each of the connecting tubes is communicated with a corresponding one of the inflow and outflow check valves.

4 Claims, 4 Drawing Sheets

MANUAL PUMP

This is a divisional of application Ser. No. 08/700,115 filed Aug. 20, 1996, now abandoned.

BACKGROUND OF THE INVENTION

1. Field of the Invention

This invention relates to a manual pump, more particularly to a manual pump which has a simple structure.

2. Description of the Related Art

The improvement of this invention is directed to the conventional manual pumps which are disclosed in the applicant's U.S. Pat. Nos. 5,156,538 and 5,489,196, issued on Oct. 20, 1992 and Feb. 6, 1996, respectively. Although the conventional manual pumps can be used to achieve the intended purposes, their structures are relatively complicated.

SUMMARY OF THE INVENTION

It is therefore a main object of the present invention to provide a manual pump which has a simple structure.

According to the present invention, the manual plump comprises first and second tubular members. The first tubular member has an upper closed end, a lower open end, and a piston member extending through and mounted movably in the first tubular member. The second tubular member has an upper open end which is fixed sealingly to the lower open end of the first tubular member, a lower closed end, an inflow check valve, an outflow check valve, and two connecting tubes connected to the external face of the second tubular member. Each of the connecting tubes communicate with a corresponding one of the inflow and outflow check valves.

Preferably, the manual pump further has at least one extension pipe which is connected detachably to one of the connecting tubes in an water-tight relationship.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
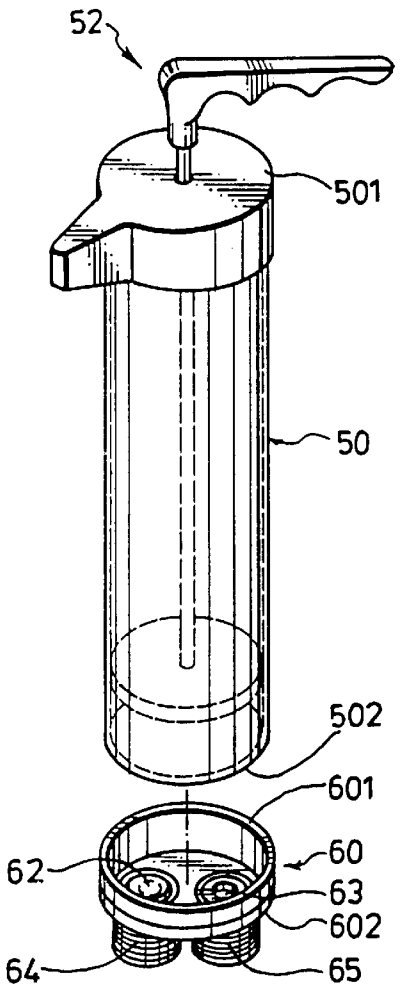
FIG. 1 is a perspective exploded view of a preferred embodiment of a manual pump according to the present invention.

Referring to FIG. 1, a preferred embodiment of a manual pump according to the present invention is shown to comprise a first tubular member 50 and a second tubular member 60.

The first tubular member 50 has an upper closed end 501, a lower open end 502, and a piston member 52 extending through and mounted movably in the first tubular member 50. The second tubular member 60 has an upper open end 601 which is fixed sealingly to the lower open end 502 of the first tubular member 50, a lower closed end 602, an inflow check valve 62, an outflow check valve 63, and two connecting tubes 64, 65 which are connected to the lower face of the lower closed end 602 of the second tubular member 60. Each of the connecting tubes 64, 65 is communicated with a corresponding one of the inflow and outflow check valves 62, 63 and is provided with an external thread.

Figure 2:
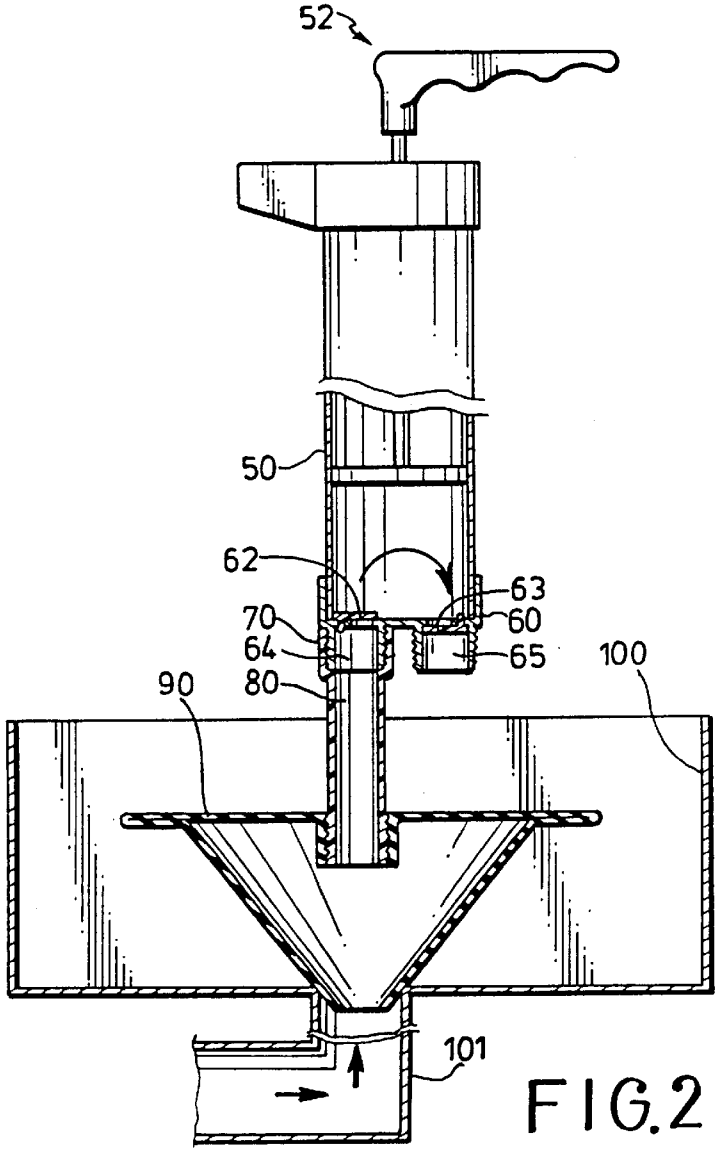
FIG. 2 is a schematic view illustrating the preferred embodiment of the manual pump in a first operative position according to the present invention.

An extension pipe 70 may engage detachably the connecting tube 64 in a water-tight relationship by means of engaging threadedly an upper internal threaded end 80 of the extension pipe 70 and the external thread of the connecting tube 64, as best illustrated in FIG. 2. The lower end of the extension pipe 70 is connected threadedly to a rubber suction cup 90 which is in turn disposed in a toilet bowl 100. When the piston member 52 is pulled upward in the first tubular member 50, a suction force can be created to draw the fluid in the toilet bowl 100 into the second and first tubular members 60, 50 through the inflow check valve 62. On the other hand, when the piston member 52 is depressed down in the first tubular member 50, a compressive force is created to force the fluid out of the first and second tubular members 50, 60 through the outflow check valve 63. Therefore, the blocks in the toilet bowl 100 can be drawn out of the drain pipe 101 of the toilet bowl 100 by plugging the restricted end of the suction cup 90 into the drain pipe 101 of the toilet bowl 100 and moving the piston member 52 up and down, as shown in FIG. 2.

Figure 3:
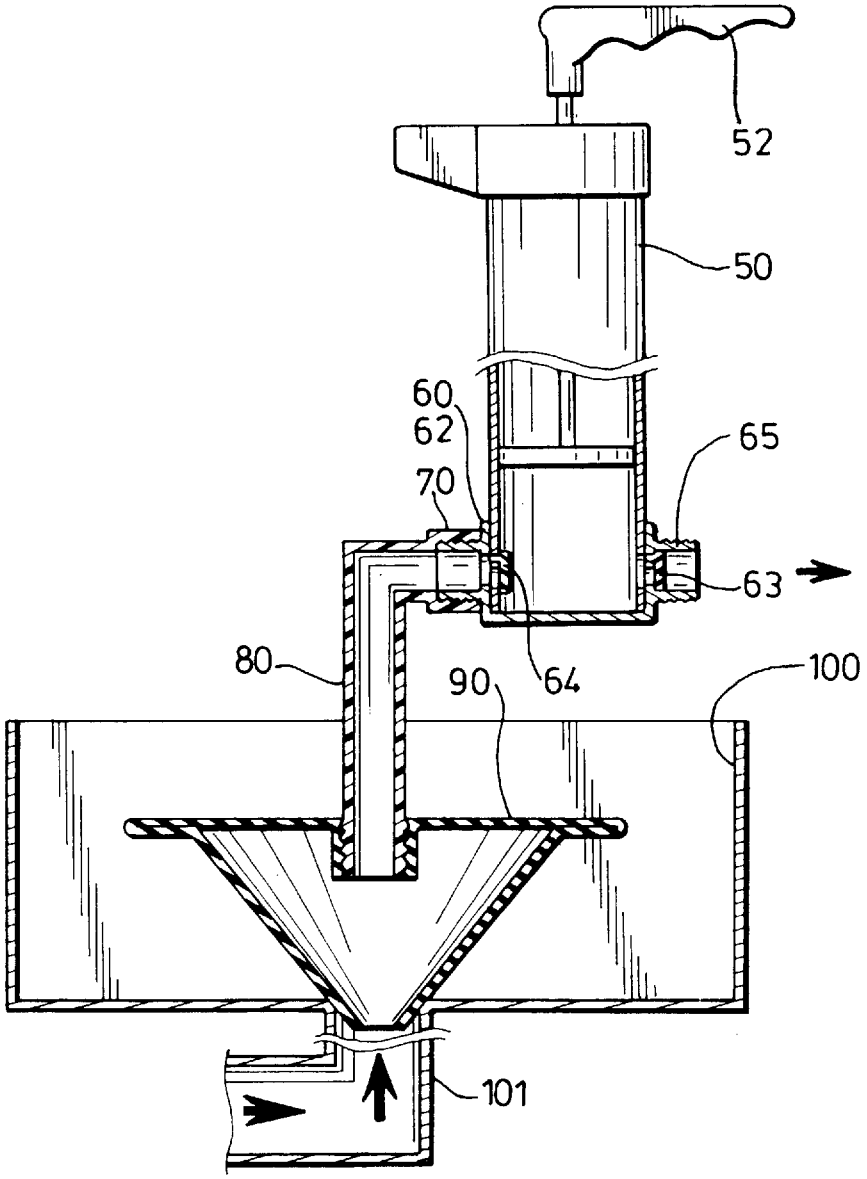
FIG. 3 is a schematic view illustrating the second embodiment of the manual pump in a first operative position according to the present invention.

The extension pipe 80 may interconnect the toilet bowl 100 and the connecting tube 65 which is in turn connected to the outflow check valve 63 in order to pump air into the drain pipe 101 of the toilet bowl 100 and to force the blocks out of the drain pipe 101 by means of actuating the piston member 52 in an above-mentioned manner. The inflow check valve 62 with connecting tube 64 and outflow check valve 63 with connecting tube 65 may be located in the side of second tubular member 60, as best illustrated in FIG. 3. The extension pipe 70 is connected threadedly to an inverted truncated conical suction cup 90.

Figure 4:
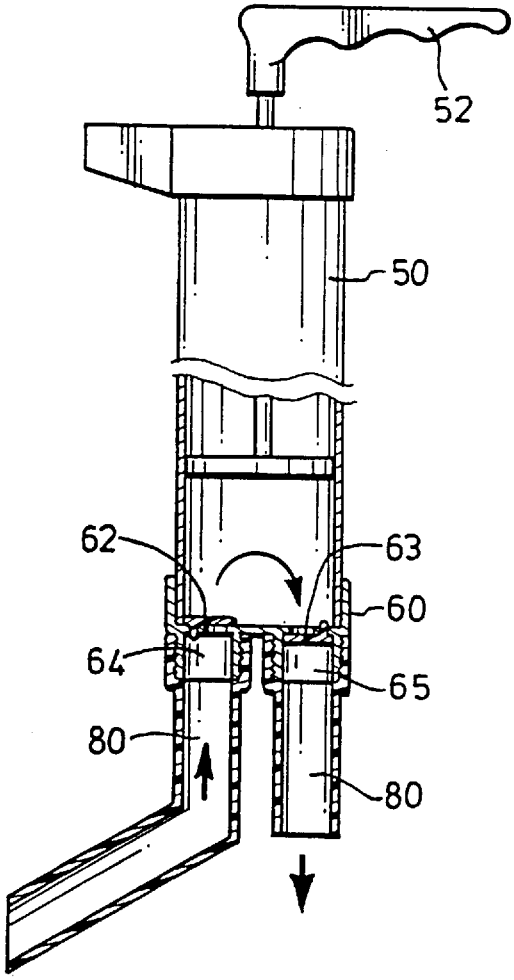
FIG. 4 is a schematic view illustrating a third embodiment of the manual pump according to the present invention.

Each of the connecting tubes 64, 65 may have an extension pipe 80 connected thereto, as shown in FIG. 4. A fluid can be drawn from one of the extension pipes 80 into the manual pump and forced out of the manual pump via the other one of the extension pipes 80. Therefore, the manual pump of the present invention can be used to evacuate a container or to inflate balls, tires, etc.

Figure 5:
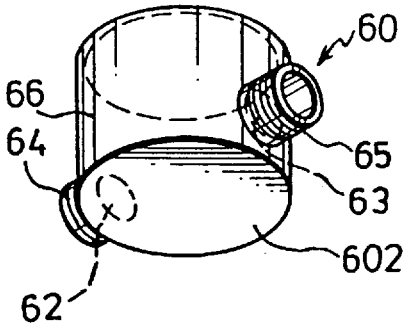
FIG. 5 is a perspective view of a part of the second embodiment of the second tubular member of the manual pump according to the present invention.
Figure 6:
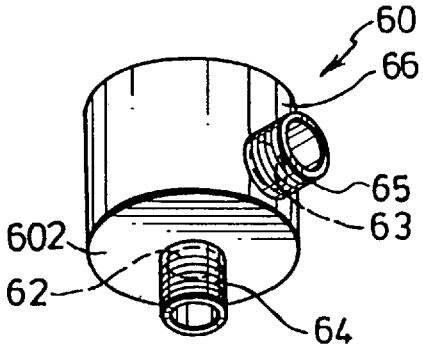
FIG. 6 is a perspective view of still another preferred embodiment of the second tubular member of the manual pump according to the present invention.

FIGS. 5 and 6 show alternative preferred embodiments of the second tubular member 60 of the manual pump. The inflow and outflow check valves 62, 63 and the corresponding connecting tubes 64, 65 can be formed in the side wall 66 of the second tubular member 60 in an aligned relationship, as best illustrated in FIG. 5, or formed respectively in the lower closed end 602 and the side wall 66 of the second tubular member 60, as best illustrated in FIG. 6. In either of these embodiments, the lower end of the connecting tubes may be connected threadedly to the inverted truncated conical suction cup 90 as shown in FIG. 3.

It is noted that the structure of the manual pump of the present invention is relatively simple when compared to the conventional manual pump and can be used to pump a fluid from one place to another place in a variety of applications.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A manual pump for use with a drain pipe of a toilet bowl, said manual pump comprising:

a first tubular member having an upper closed end, a lower open end, and a piston member extending through and mounted movably in said first tubular member;

a second tubular member having an upper open end which is fixed sealingly to said lower open end of said first tubular member, a lower closed end, an inflow check valve, an outflow check valve, and two connecting tubes connected to an external face of said second tubular member, each of said connecting tubes being communicated with a corresponding one of said inflow and outflow check valves;

at least one extension pipe having an upper end which is connected detachably to one of said connecting tubes in an water-tight relationship and a lower end; and an inverted truncated conical cup member having an enlarged upper end which is connected detachably to said lower end of said at least one extension pipe and a restricted lower end, said cup member being made of a rubber material such that said restricted lower end is plugged sealingly into said drain pipe of said toilet bowl when being pressed against the same.

2. The manual pump as claimed in claim 1, wherein said inflow and outflow check valves are formed in said lower closed end of said second tubular member.

3. The manual pump as claimed in claim 1, wherein said second tubular member has a side wall interconnecting said upper open end and said lower closed end thereof, said inflow and outflow check valves being formed in said side wall of said second tubular member.

4. The manual pump as claimed in claim 1, wherein one of said inflow and outflow check valves is formed in said lower closed end of said second tubular member and the other one of said inflow and outflow check valves is formed in said side wall of said second tubular member.

* * * * *